US008847463B2

(12) United States Patent
Neuweger et al.

(10) Patent No.: US 8,847,463 B2
(45) Date of Patent: Sep. 30, 2014

(54) CARBON BRUSH FOR TRANSMITTING HIGH CURRENTS

(75) Inventors: Henrik Neuweger, Herborn (DE); Hans Lippert, Lauterbach (DE); Thomas Weber, Leun (DE); Andreas Reetz, Heuchelheim (DE)

(73) Assignee: Schunk Kohlenstofftechnik GmbH, Heuchelheim (DE)

( * ) Notice: Subject to any disclaimer, the term of this patent is extended or adjusted under 35 U.S.C. 154(b) by 0 days.

(21) Appl. No.: 12/625,930

(22) Filed: Nov. 25, 2009

(65) Prior Publication Data

US 2010/0133951 A1 Jun. 3, 2010

(30) Foreign Application Priority Data

Nov. 28, 2008 (DE) ..... 10 2008 059 478

(51) Int. Cl.

| | |
|---|---|
| ***H01R 39/24*** | (2006.01) |
| ***H01R 39/26*** | (2006.01) |
| ***H01R 39/27*** | (2006.01) |
| ***H01R 39/38*** | (2006.01) |
| ***H01R 39/20*** | (2006.01) |
| *H01R 39/36* | (2006.01) |

(52) U.S. Cl.

CPC ..... *H01R 39/20* (2013.01); *H01R 39/36* (2013.01)

USPC ..... 310/251; 310/248; 310/249; 310/252; 310/253

(58) Field of Classification Search

CPC ..... H01R 39/26; H01R 39/24; H01R 39/27; H01R 39/32

USPC ..... 310/248–253

See application file for complete search history.

(56) References Cited

U.S. PATENT DOCUMENTS

| | | | | |
|---|---|---|---|---|
| 3,601,645 | A | 8/1971 | Whiteheart | |
| 3,980,914 | A * | 9/1976 | Cunningham | 310/251 |
| 4,084,669 | A | 4/1978 | Suwa et al. | |

(Continued)

FOREIGN PATENT DOCUMENTS

| | | |
|---|---|---|
| DE | 1215938 B | 5/1966 |
| DE | 1926203 A1 | 11/1969 |

(Continued)

OTHER PUBLICATIONS

Engineering ToolBox; http://www.engineeringtoolbox.com/resistivity-conductivity-d_418.html.*

(Continued)

*Primary Examiner* — Terrance Kenerly
(74) *Attorney, Agent, or Firm* — McGlew and Tuttle, P.C.

(57) ABSTRACT

The embodiments of the invention relate to a carbon brush for transmitting high currents, having a connecting element for connecting an electrical track and a consumable contact element with a contact surface that is designed to lie flush against a commutator device, wherein the connecting element and the contact element are combined in a layer transition zone aligned perpendicularly to the direction of wear of the carbon brush and form a one-piece molded body, wherein the connecting element and the contact element have different compositions, such that a carbon component of the contact element is greater than the carbon component of the connecting element and the contact element has a metal component differing from that of the connecting element.

20 Claims, 2 Drawing Sheets

(56) References Cited

U.S. PATENT DOCUMENTS

| | | | | | |
|---|---|---|---|---|---|
| 4,443,726 | A | * | 4/1984 | Ikegami et al. | 310/248 |
| 5,168,620 | A | * | 12/1992 | Denney et al. | 29/597 |
| 5,441,683 | A | * | 8/1995 | Kammerer et al. | 264/105 |
| 5,481,150 | A | * | 1/1996 | Tanaka et al. | 310/249 |
| 5,701,046 | A | * | 12/1997 | Kammerer et al. | 310/251 |
| 5,739,619 | A | * | 4/1998 | Thornley | 310/248 |
| 2003/0107294 | A1 | * | 6/2003 | Otani et al. | 310/252 |
| 2003/0155837 | A1 | * | 8/2003 | Takahashi et al. | 310/253 |
| 2008/0214032 | A1 | | 9/2008 | Lippert et al. | |
| 2009/0261687 | A1 | | 10/2009 | Lippert | |

FOREIGN PATENT DOCUMENTS

| | | | |
|---|---|---|---|
| DE | 75346 | | 8/1970 |
| DE | 4430745 | A1 | 3/1995 |
| DE | 10344717 | A1 | 2/2005 |
| DE | 10359896 | A1 | 7/2005 |
| DE | 102005013106 | A1 | 9/2006 |
| DE | 202007003159 | U1 | 5/2007 |
| DE | 102006006313 | A1 | 8/2007 |
| EP | 0107386 | A1 | 5/1984 |
| GB | 2038565 | A | 7/1980 |
| WO | 2005064756 | A1 | 7/2005 |

OTHER PUBLICATIONS

EP Application No. 09 17 4288, European Search Report dated Feb. 20, 2013.

* cited by examiner

CARBON BRUSH FOR TRANSMITTING HIGH CURRENTS

Embodiments of the present invention relate to a carbon brush for transmitting high currents, having a connecting element for connecting an electrical connection track and a consumable contact element with a contact surface that is designed to contact a slip ring device, particularly a commutator.

Carbon brushes of the kind described in the introduction are often referred to as "industrial carbon brushes" and are used particularly in situations that require transmission of high currents, often in excess of 20 ampere/cm2. In this context, carbon brushes of such kind are used in motors and generators, and use of the generators with these carbon brushes is becoming increasingly popular in wind turbines.

Because of the high outputs the industrial carbon brushes are required to transmit is such cases, it is imperative to add sufficient fractions of metallic inclusions to the carbon, to help to reduce contact resistances as much as possible and so minimise the heating of the carbon brushes caused by electrical resistance. To this end it has proven advantageous to manufacture the carbon brushes, which are usually produced as moulded parts, from a particulate moulding compound consisting mostly of a suitable metal, particularly silver. In practice, the silver component in industrial carbon brushes is frequently as high as 60% and more. As a result, the production costs for carbon brushes are considerable due to the quantity of silver alone, without taking into account the production costs associated with any given process.

The known industrial carbon brushes are manufactured as essentially homogeneous moulded parts, the composition of which is consistent for both the contact element that contacts the slip ring device during operation and the connecting element to which the electrical connection track is connected. Consequently, this means that a significant portion of the silver in the carbon brush, which is consumed together with the carbon in the contact element as the carbon brush is worn down, is also present in the connecting element, where the specific material properties of the silver are not required, even though they are essential for interacting with the carbon in the contact element. The connecting element in the carbon brush serves instead to establish an electrically conductive connection with the connection track. Once the contact element has been used up, the connecting element is usually disposed of, together with the silver it contains.

Accordingly, the methods used until now for manufacturing industrial carbon brushes have entailed using a quantity of silver, not all of which is needed for operating the carbon brushes.

An object of the embodiments of the present invention is therefore to suggest a carbon brush for transmitting high currents which enables the carbon brush to function reliably and at the same time is associated with lower manufacturing costs than the known carbon brushes.

The carbon brush according to the embodiments of the invention for transmitting high currents includes a moulded body the composition of which is varied according to the different functions of the brush areas, in which the connecting element serves to provide a connection with an electrical connection track and the contact element serves to ensure uninterrupted contact with the material of the counter-contact element or the slip ring device, and unlike the connecting element must ensure flush contact with the material of the counter-contact through wear.

In the carbon brush according to the embodiments of the invention, the connecting element and the contact element are combined in a layer transition zone aligned perpendicularly to the direction of wear of the carbon brush and form a one-piece moulded body having different compositions that are adapted to the different functions of the connecting element and the contact element. Accordingly, the carbon fraction in the contact element is greater than the carbon fraction in the connecting element, because the carbon is important for creating the desired low-friction contact. Besides its carbon content, the contact element also includes a metal fraction, which is different from the metal fraction in the connecting element, so that the metal fractions in each may be optimised for the different functions of the metal fractions in the contact element and the connecting element. Thus, a metal may be selected for the contact element that both enables generation of a desirable low contact resistance, and also has relatively low abrasive properties so as to minimise its negative effect on the advantageous properties of the carbon for the purposes of establishing a low-friction contact. For the connecting element, which is separated from the consumable part of the carbon brush by the layer transition zone, and for which wear-related properties are therefore of secondary importance, a metal fraction may thus be used that has both sufficient mechanical strength to fulfill its mechanical connecting function and good electrical conductivity for creating the electrical connection with the connection track, without regard for its abrasive properties.

The carbon brush according to the embodiments of the invention is thus defined as a carbon brush in which areas are separated by the layer transition zone, each of which areas may be optimised with respect to their essential functions independently of the other area. In this way, it is also possible to significantly reduce the proportion of silver in the carbon brush compared with the known carbon brush because in the design of the embodiments of the invention, the silver content is then only needed for the contact element. Accordingly, the remaining part of the brush, which must be disposed of and essentially consists only of the connecting element when a carbon brush has been worn down to the layer transition zone, contains no silver at all.

In a preferred embodiment of the carbon brush according to the invention, the contact element has a metal content composed mostly of silver and the connecting element has a metal content composed mostly of copper. In this way, it is possible to create a carbon brush that is optimised with regard to selecting the respective metal for the contact element and the connecting element. Of course other metals, now known or later discovered, may be used that satisfy the mechanical and electrical requirements of the elements.

The fraction of metal in the contact element may be about 50% or more depending on the requirement for the carbon brush. Depending on this requirement, the metal content in the contact element may be up to 100% of a copper material or a copper alloy.

A particularly high-strength embodiment, capable of withstanding extremely high mechanical loads, is created if the connecting element is made from about 100% copper or a copper alloy.

If, as in a particularly advantageous embodiment of the carbon brush, the contact element next to the layer transition zone has an indicator area formed opposite a consumable area with different composition and provided with a contact surface, which indicator area has a metal component that differs from the consumable area, it is possible to form a consumable or maintenance indicator on the carbon brush as a multilayer construction is worn down without the need to provide special, separate contact devices. In this embodiment, it is simple to exploit the advantageous effect that is created when the contact surface is formed in the indicator area, causing the resistance to change because the metal component of the indicator area differs from that of the consumable area, This change in resistance may be used as a signal to indicate that the carbon brush needs to be replaced.

Regardless of the formation of an indicator area on the carbon brush, in any case it is advantageous if the connection element has a flat connecting surface for creating a soldered or welded connection to the electrical track, so that it is possible to create a simple, flat attachment to the connecting track with a soldered or welded connection without the need for special retaining devices on the connection element.

In the following, preferred embodiments of the invention will be explained with reference to the drawing.

DETAILED DESCRIPTION OF THE PREFERRED EMBODIMENTS OF THE INVENTION

Figure 1:
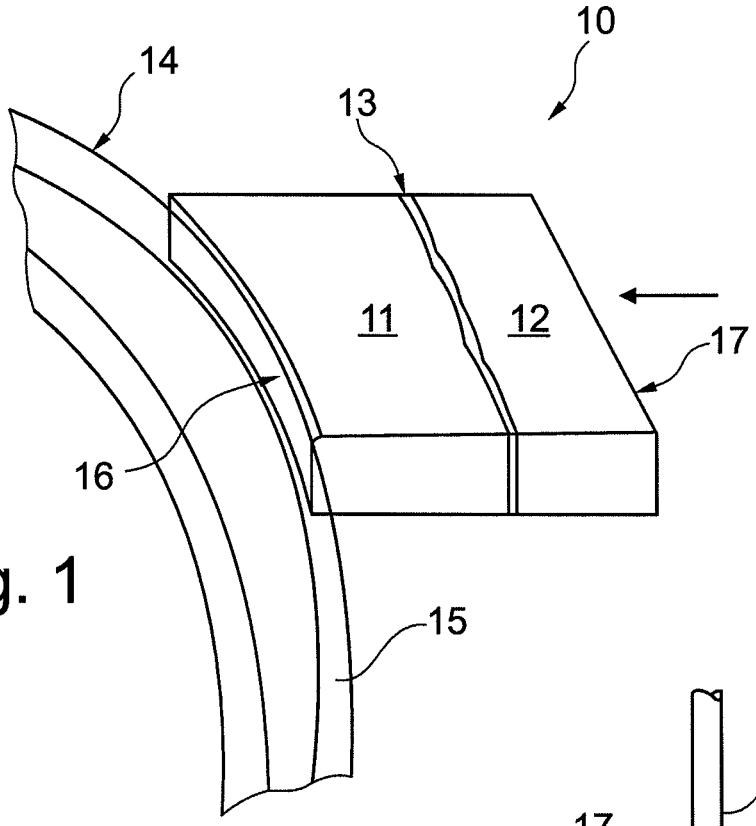
FIG. 1 illustrates a first embodiment of a carbon brush according to the invention.

FIG. 1 shows a carbon brush 10 having a contact element 11 and a connection element 12, each of which are manufactured from individual moulding particles 24, 25, 26 (FIG. 4*a*) and are connected to each other in a single part via a layer transition zone 13. The carbon brush shown in FIG. 1 may be produced by means of the compression moulding method illustrated in the following with reference to FIGS. 4*a* to 4*c* in such manner that carbon brush 10 is created as a moulded part by suitable compression, and the pressure exerted on the mould particles of contact elements 11 and 12 causes connection element 12 to permeate contact element 11 in the layer transition zone 13, this permeation being limited to layer transition zone 13.

In the case of the embodiment shown in FIG. 1, contact element 11 consists of a mixture of about 60 percent by weight silver and about 40 percent by weight carbon and is consumed in the direction of the compression force indicated in FIG. 1 by the arrow. In the case of the embodiment of carbon brush 10 shown in FIG. 1, connection element 12 is made of pure copper.

Contact element 11 has a contact area 16 adjacent with a contact surface 14 of a commutator ring 15 indicated in FIG. 1, which contact area is conformed to lie flush with the contour of contact surface 14.

Figure 2:
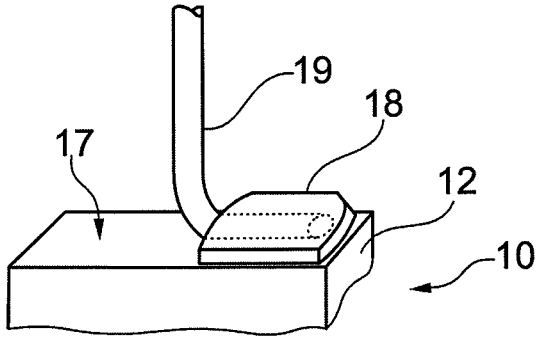
FIG. 2 shows the carbon brush of FIG. 1 with a connection side conformed on the connecting element of the carbon brush.

FIG. 2 shows a flat connecting surface 17, formed in the present case by the rear face of connection element 12, and which serves to create an electrically conductive connection between connection element 12 and electrical connecting track 19, created here for example by a soldered connection 18.

Figure 3:
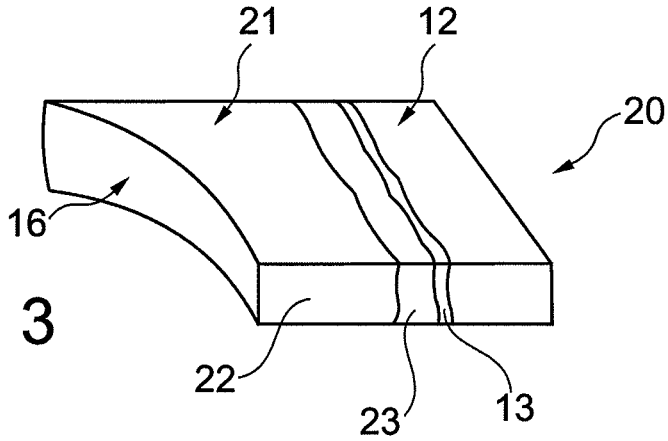
FIG. 3 illustrates a further embodiment of a carbon brush according to the invention.

FIG. 3 shows a further embodiment of a carbon brush 20, differing from the carbon brush 10 shown in FIG. 1 in that it has a contact element 21 that has a consumable area 22 adjacent contact surface 16 and an indicator area 23 attached to the consumable area and located adjacent layer transition zone 13. Similarly to the carbon brush 10 shown in FIG. 1, a connecting element 12 is attached to layer transition zone 13.

In the embodiment of the carbon brush 20 shown in FIG. 3, indicator area 23 is distinguished from consumable area 22 by a relatively lower silver component.

Figure 4A:
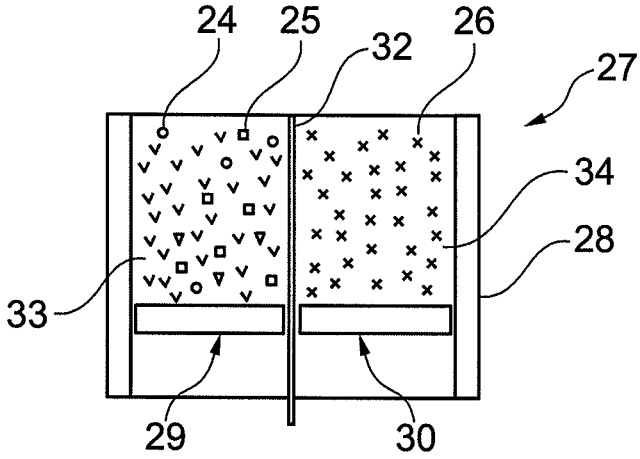
FIGS. 4*a* to 4*c* show a method for manufacturing the carbon brush of FIG. 1.
Figure 4B:
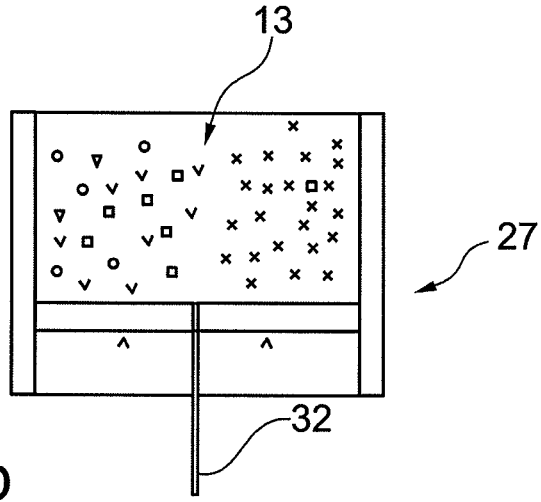
Figure 4C:
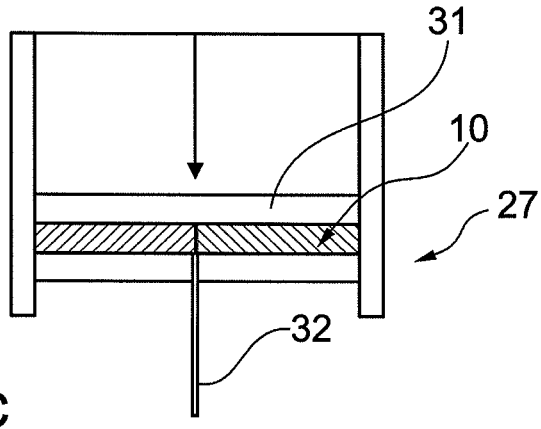

As is shown in FIGS. 4*a* to 4*c*, one option for manufacturing carbon brush 10 consists in using a moulding device 27 including a moulding tool 28 and a number of form punches 29 to 31, wherein in a first step separate mould areas 33 and 34 are filled with mould particles 24, 25 and 26 corresponding to the desired material compositions of contact element 11 and connection element 12 are filled, for example by a slide. In the example of carbon brush 10, mould particles 24 are graphite, mould particles 25 are silver and mould particles 26 are copper.

Then, slide 32 is withdrawn from the moulding tool (FIG. 4*b*) so that mould particles 24, 25 disposed in first mould area 33 come into direct contact with mould particles 26 located in second mould area 34, and layer transition zone 13 is formed. When mould particles 24, 25 and 26 are compressed subsequently, carbon brush 10 is finally produced by form punch 31 which is lowered from above (FIG. 4*c*). Subsequent partitioning, as illustrated by carbon brush 20 in FIG. 3, may be performed with a corresponding number and arrangement of additional slides in the moulding tool.

What is claimed is:

1. A carbon brush for transmitting high currents, the brush comprising:

a connection element for connecting an electrical connection track, the connection element having a first composition;

a consumable contact element having a contact surface that is designed to lie flush against a commutator device, the contact element having a second composition different than the first composition; and a layer transition zone coupling the connection element with the contact element to form a one-piece molded body wherein the layer transition zone has a major axis aligned perpendicularly to the direction of wear of the carbon brush, wherein the second composition has a greater carbon fraction than the first composition, wherein the first and the second composition each have a metal fraction, the metal fraction of the second composition differing from the metal fraction of the first composition, said metal fraction of said second composition being greater than said carbon fraction of said second composition, wherein the metal fraction of the contact element is mostly silver and the metal fraction of the connecting element is mostly copper.

2. The brush of claim 1, wherein the contact element consists of at least 50% by weight of silver or silver alloy and the connecting element consists of at least 50% by weight of copper or a copper alloy.

3. The brush of claim 2, wherein the connecting element consists of 100% by weight of copper or a copper alloy.

4. The brush of claim 1, further comprising an indicator area located between the contact element and the layer transition zone, the indicator area has a third composition different than the second composition with the third composition having a metal fraction different than the metal fraction of the second composition.

5. The brush of claim 1, wherein the connection element has a flat connecting surface for creating a soldered or welded connection with the electrical track.

6. A carbon brush, comprising:

a connection element for connecting an electrical connection track, the connection element having a first composition;

a consumable contact element having a contact surface that is designed to lie flush against a commutator device, the contact element having a second composition different than the first composition; and a layer transition zone coupling the connection element with the contact element to form a one-piece molded body wherein the layer transition zone has a major axis aligned perpendicularly to the direction of wear of the carbon brush, wherein the second composition has a greater carbon fraction than the first composition, wherein the first and the second composition each have a metal fraction, the metal fraction of the second composition differing from the metal fraction of the first composition, said metal fraction of said second composition being greater than said carbon fraction of said second composition, wherein said contact element comprises 60% by weight of silver and 40% by weight of carbon and said connection element is formed of 100% by weight of copper.

7. A carbon brush for transmitting high currents, the brush comprising:

a connection element for connecting an electrical connection track, the connection element having a first composition;

a consumable contact element having a contact surface that is designed to lie flush against a commutator device, the contact element having a second composition different than the first composition, said second composition comprising a mixture of silver and carbon, wherein a weight percent of silver in said mixture is greater than a weight percent of carbon in said mixture; and a layer transition zone coupling the connection element with the contact element to form a one-piece molded body, wherein the layer transition zone has a major axis aligned perpendicularly to the direction of wear of the carbon brush, said weight percent of carbon in said second composition being greater than a weight percent of carbon of the first composition, wherein each of the first composition and the second composition has a metal fraction, the metal fraction of the second composition differing from the metal fraction of the first composition.

8. The brush of claim 7, wherein the metal fraction of the contact element is mostly silver and the metal fraction of the connecting element is mostly copper.

9. The brush of claim 8, wherein the contact element consists of at least 50% by weight of silver or silver alloy and the connecting element consists of at least 50% by weight of copper or a copper alloy.

10. The brush of claim 9, wherein the connecting element consists of 100% by weight of copper or a copper alloy.

11. The brush of claim 7, further comprising an indicator area located between the contact element and the layer transition zone, the indicator area has a third composition different than the second composition with the third composition having a metal fraction different than the metal fraction of the second composition.

12. The brush of claim 9, wherein the connection element has a flat connecting surface for creating a soldered or welded connection with the electrical track.

13. The brush of claim 7, wherein said contact element comprises 60% by weight of silver and 40% by weight of carbon and said connection element is formed of 100% copper.

14. A carbon brush for transmitting high currents, the brush comprising:

a connection element for connecting an electrical connection track, the connection element having a first composition;

a consumable contact element having a contact surface that is designed to lie flush against a commutator device, the contact element having a second composition different than the first composition, said second composition comprising silver and carbon, wherein a weight percent of silver in said second composition is greater than a weight percent of carbon in said second composition; and a layer transition zone coupling the connection element with the contact element to form a one-piece molded body, wherein the layer transition zone has a major axis aligned perpendicularly to the direction of wear of the carbon brush, said weight percent of carbon in said second composition being greater than a weight percent of carbon of the first composition, wherein said first composition comprises a metal, said metal being different from said silver of said second composition.

15. The brush of claim 14, wherein the metal fraction of the contact element is mostly silver and the metal fraction of the connecting element is mostly copper.

16. The brush of claim 15, wherein the contact element consists of at least 50% by weight of silver or silver alloy and the connecting element consists of at least 50% by weight of copper or a copper alloy.

17. The brush of claim 16, wherein the connecting element consists of 100% by weight of copper or a copper alloy.

18. The brush of claim 14, further comprising an indicator area located between the contact element and the layer transition zone, the indicator area has a third composition different than the second composition with the third composition having a metal fraction different than the metal fraction of the second composition.

19. The brush of claim 14, wherein said contact element comprises 60% by weight of silver and 40% by weight of carbon and said connection element is formed of 100% copper.

20. A carbon brush for transmitting high currents, the brush comprising:

a connection element for connecting an electrical connection track, the connection element having a first composition;

a consumable contact element having a contact surface that is designed to lie flush against a commutator device, the contact element having a second composition different than the first composition;

a layer transition zone coupling the connection element with the contact element to form a one-piece molded body wherein the layer transition zone has a major axis aligned perpendicularly to the direction of wear of the carbon brush, wherein the second composition has a greater carbon fraction than the first composition, wherein the first and the second composition each have a metal fraction, the metal fraction of the second composition differing from the metal fraction of the first composition, said metal fraction of said second composition being greater than said carbon fraction of said second composition; and an indicator area located between the contact element and the layer transition zone, wherein the indicator area has a third composition different than the second composition with the third composition having a metal fraction different than the metal fraction of the second composition.

* * * * *